US005675116A

United States Patent [19]

Hillenbrand

[11] Patent Number: 5,675,116

[45] Date of Patent: Oct. 7, 1997

[54] UNMANNED UNDERSEA VEHICLE INCLUDING KEEL-MOUNTED PAYLOAD DEPLOYMENT ARRANGEMENT WITH PAYLOAD COMPARTMENT FLOODING ARRANGEMENT TO MAINTAIN AXI-SYMMETRICAL MASS DISTRIBUTION

[75] Inventor: Christopher F. Hillenbrand, Bristol, R.I.

[73] Assignee: The United States of America as represented by the Secretary of the Navy, Washington, D.C.

[21] Appl. No.: 540,607

[22] Filed: Oct. 11, 1995

[51] Int. Cl.[6] ..... B63G 8/28

[52] U.S. Cl. ..... 114/21.2; 114/316; 114/318; 89/1.81

[58] Field of Search ..... 114/21.2, 316, 114/317, 318; 89/1.809, 1.81; 102/411

[56] References Cited

U.S. PATENT DOCUMENTS

| | | | |
|---|---|---|---|
| 5,076,192 | 12/1991 | Tegel et al. | 114/316 |
| 5,163,379 | 11/1992 | Chorley | 114/317 |
| 5,248,978 | 9/1993 | Manthy et al. | 342/54 |
| 5,267,220 | 11/1993 | Burt | 367/131 |
| 5,442,358 | 8/1995 | Keeler et al. | 342/54 |
| 5,447,115 | 9/1995 | Moody | 114/312 |
| 5,448,941 | 9/1995 | Godfrey et al. | 89/1.809 |

*Primary Examiner*—Michael J. Carone
*Assistant Examiner*—Matthew J. Lattig
*Attorney, Agent, or Firm*—Michael J. McGowan; Michael F. Oglo; Prithvi C. Lall

[57] ABSTRACT

An unmanned undersea vehicle system comprises an axi-symmetrical cylindrically-shaped self-propelled undersea deployment vehicle of predetermined diameter, the undersea deployment vehicle having an amidships undersea weapon compartment. The weapon compartment includes elements for receiving a weapon and a buoyancy chamber positioned axi-symmetrically within the weapon compartment. The buoyancy chamber is initially empty and has sufficient capacity so that it can be loaded with seawater whose mass approximates the mass of the weapon. The weapon compartment further includes controllable valves for enabling seawater surrounding the vehicle to fill the buoyancy chamber. A control element controls the deployment of the weapon by expelling the weapon from the weapon compartment and thereafter controlling the firing of the weapon, contemporaneously controlling the valves during weapon deployment to enable filling of the buoyancy chamber to maintain an axi-symmetrical distribution of mass as the weapon is deployed.

3 Claims, 9 Drawing Sheets

UNMANNED UNDERSEA VEHICLE INCLUDING KEEL-MOUNTED PAYLOAD DEPLOYMENT ARRANGEMENT WITH PAYLOAD COMPARTMENT FLOODING ARRANGEMENT TO MAINTAIN AXI-SYMMETRICAL MASS DISTRIBUTION

STATEMENT OF GOVERNMENT INTEREST

The invention described herein may be manufactured by or for the Government of the United States of America for Governmental purposes without the payment of any royalties thereon or therefor.

CROSS-REFERENCE TO RELATED APPLICATIONS

"Unmanned Undersea Vehicle With Keel-Mounted Payload Deployment System" U.S. patent application Ser. No. 08/540,612, filed of even date herewith in the name of Christopher F. Hillenbrand.

"Unmanned Undersea Weapon Deployment Structure With Cylindrical Payload Deployment System" U.S. patent application Ser. No. 08/540,613, filed of even date herewith in the name of Christopher F. Hillenbrand.

"Unmanned Undersea Vehicle With Erectable Sensor Mast For Obtaining Position and Environmental Vehicle Status" U.S. patent application Ser. No. 08/540,608, filed of even date herewith in the names of Christopher F. Hillenbrand and Donald T. Gomez.

"Unmanned Undersea Vehicle System for Weapon Deployment" U.S. patent application Ser. No. 08/540,611, filed of even date herewith in the names of Christopher F. Hillenbrand and Donald T. Gomez.

"System for Deploying Weapons Carried In An Annular Configuration In A UUV" U.S. patent application Ser. No. 08/540,609, filed of even date herewith in the names of Christopher F. Hillenbrand and Donald T. Gomez.

"Unmanned Undersea Weapon Deployment Structure With Cylindrical Payload Configuration" U.S. patent application Ser. No. 08/540,610, filed of even date herewith in the name of Christopher F. Hillenbrand.

BACKGROUND OF THE INVENTION (1) Field of the Invention

The invention relates generally to the field of nautical weapon delivery systems and more particularly to nautical systems for covertly deploying multiple weapons while eliminating the necessity of having manned ships or submarines present at the deployment site.

(2) Description of the Prior Art

Underwater missiles and torpedoes are currently launched from either the offside of a manned ship or from the torpedo tube of a manned submarine. This current method of deploying underwater weapons requires the actual presence of the ship and/or submarine at the deployment site, thereby posing a number of dangers, including (1) the lives of the people on the ship or submarine, including the equipment itself, are exposed to enemy fire in a danger zone, and (2) ships, as well as submarines in shallow water, are exposed and thereby easily detected by an enemy.

Conventional wire-guided torpedoes are available as generally unmanned vehicles, but there are a number of problems in using them as a weapon system platform. A torpedo does not have an arrangement for compensating for buoyancy when a weapon is released from a torpedo shell. Thus, the shock to the torpedo carrier when a weapon is launched will result in an unstable carrier. Also, the torpedo carrier itself is not recoverable, and hence can only be used once.

SUMMARY OF THE INVENTION

It is therefore an object of the invention to provide a new and improved unmanned undersea weapon deployment structure.

In brief summary, the invention provides an unmanned undersea vehicle system comprising an axi-symmetrical cylindrically-shaped self-propelled undersea deployment vehicle of predetermined diameter said undersea deployment vehicle having an amidships undersea weapon compartment. The weapon compartment includes means for receiving a weapon and a buoyancy chamber positioned axi-symmetrically within the weapon compartment. The buoyancy chamber is initially empty and has sufficient capacity so that it can be loaded with seawater whose mass approximates the mass of the weapon. The weapon compartment further includes controllable valve means for enabling seawater surrounding the vehicle to fill the buoyancy chamber. Control means controls the deployment of the weapon by expelling the weapon from the weapon compartment and thereafter controlling the firing of the weapon, contemporaneously controlling the valves during weapon deployment to enable filling of the buoyancy chamber to maintain an axi-symmetrical distribution of mass as the weapon is deployed.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 1:
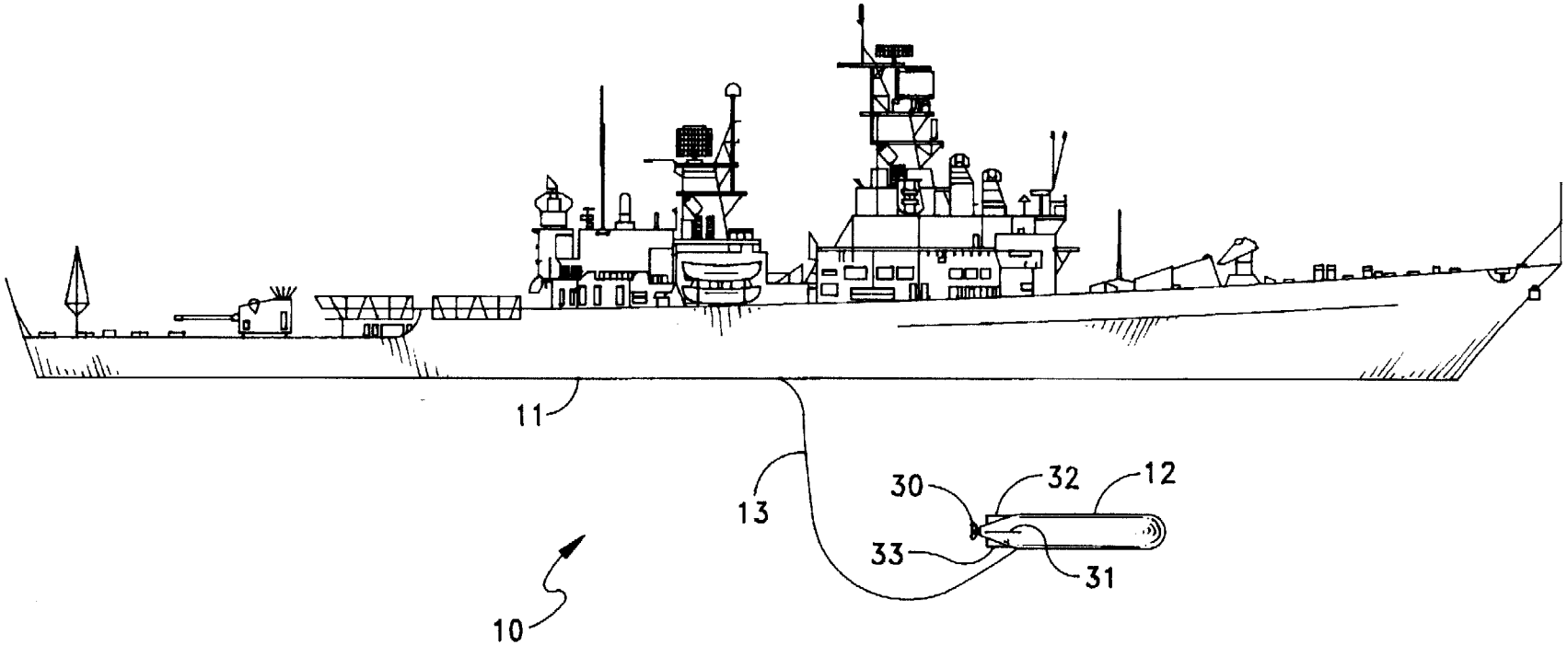
FIG. 1 depicts an unmanned undersea weapon deployment system constructed in accordance with the invention.

FIG. 1 depicts an unmanned undersea weapon deployment system 10 in accordance with the invention. With reference to FIG. 1, the system 10 includes a "mother vehicle" 11 and a unmanned undersea vehicle 12 constructed in accordance with the invention, which are interconnected by a communication link 13 such as an optical fiber. The mother vehicle 11 may be a conventional manned nautical ship (either a surface ship or a submarine), to which may be added (if necessary) mounting means (not separately shown) for holding and releasing the unmanned undersea vehicle into the ocean and for retrieving it from the ocean as described below, and means (also not separately shown) for communicating with the unmanned undersea vehicle to facilitate control of the unmanned undersea vehicle by the mother vehicle as described below.

Figure 2:
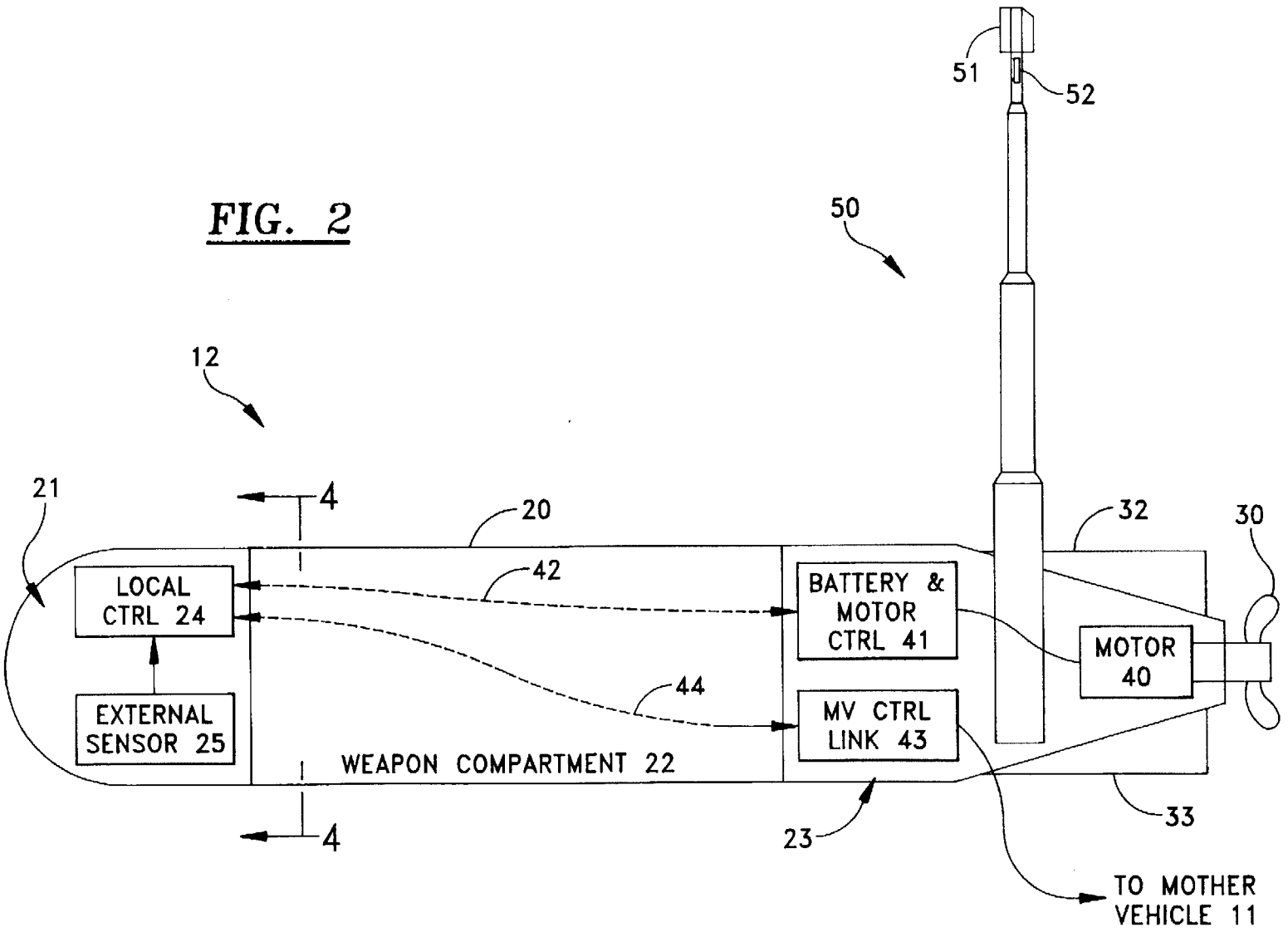
FIG. 2 depicts, in schematic form, the side elevational view of an unmanned undersea vehicle useful in the system depicted in FIG. 1.

FIG. 2 depicts, in schematic form, the side elevational view of the unmanned undersea vehicle 12 which is useful in the system 10 depicted in FIG. 1. With reference to FIG. 2, the unmanned undersea vehicle 12 includes an axisymmetrical torpedo-shaped outer hull 20 which houses a forward control system compartment 21, a weapon system compartment 22 and an aft "control effectors" compartment 23. The central portion of the outer hull 20 is generally cylindrical, with a forward rounded nose (to the left in FIG. 2) and a tapered tail (to the right in FIG. 2). Extending rearwardly of the tail portion is a propeller 30 used to drive the unmanned undersea vehicle 12 selectively in a forward or rearward direction. Extending vertically and horizontally from the tail portion are four fins 31–33. Two of the fins, one identified by reference numerals 31 (shown in FIG. 1) on opposing sides of the tail portion extend horizontally therefrom (the second horizontally-extending fin is not shown), and two fins, identified by reference numerals 32 and 33, on opposing sides extend vertically therefrom. The angular orientation of the fins relative to the longitudinal axis of the unmanned undersea vehicle 12 is adjustable to permit steering of the unmanned undersea vehicle horizontally and vertically.

The control system compartment 21 includes a number of elements, including local control circuitry 24 for controlling the various elements of the unmanned undersea vehicle 12 in response to commands provided by the mother vehicle 11 (FIG. 1), as well as in response to information as to the unmanned undersea vehicle's external environment as provided by an external sensor 25. The local control circuit 24 may include, for example, a conventional auto-pilot and a suitably-programmed digital computer, as well as electrical circuitry for providing control signals to control other components of the unmanned undersea vehicle 12 as described below. The external sensor 25 may comprise, for example, a conventional Doppler sonar device.

The aft "control effectors" compartment 23 includes several elements for propelling and steering the unmanned undersea vehicle 12 and, in one embodiment, for connecting the unmanned undersea vehicle to the communication link 13 and for reeling the communication link 13 out as the unmanned undersea vehicle moves away from the mother vehicle 11 and reeling it in as the unmanned undersea vehicle 12 returns towards the mother vehicle 11. In particular, the control effectors compartment 23 includes a motor 40 for powering the propeller 30. The motor, in turn, is powered by a battery and motor control circuit 41, which receives motor control information from the local control circuit 24 in the control system compartment 21 over a control link represented by a dashed line 42. The control effectors compartment 23 also includes motors (not shown) for controlling the orientation of the fins 31–33, which are also powered by and under control of the battery and motor control circuit 41. The battery and motor control circuit 41 also provides status information to the local control circuit over the control link 42.

In one embodiment, the control effectors compartment 23 also includes a mother vehicle control link 43, which performs the functions of connecting the unmanned undersea vehicle 12 to the communication link and reeling the communication link 13 out and in as the unmanned undersea vehicle 12 moves away from and toward the mother vehicle 11. The mother vehicle control link 43, in turn, provides the command information it receives from the communication link 13 to the local control circuit 24 over an internal communication link represented by dashed line 44. In addition, the local control circuit 24 provides unmanned undersea vehicle status information, including information as to the unmanned undersea vehicle's position and its environment, to the mother vehicle control link 43 over the internal communication link 44, and the mother vehicle control link 44 will transmit that information over the communication link 13 to the mother vehicle 11.

In one embodiment, the unmanned undersea vehicle 12 also includes an erectable mast 50, which may be extended in a telescoping manner from the control effectors compartment. The far (upper) end of the mast 50 includes sensor equipment which permits acquisition of certain positioning and environmental information. In particular, the mast 50 includes an optical and/or video camera 51, which may be a CCD device, for obtaining image information as to the vehicle's environment. The camera 51 provides the video information to the local control circuit 24, which can process the information and use it locally, and in addition can provide the processed and/or raw video information to the mother vehicle 11. The mother vehicle 11, in turn, can use the information received from the unmanned undersea vehicle 12 in determining the commands to be provided to the unmanned undersea vehicle 12.

In addition, the mast 50 includes a Geodetic Position System ("GPS") antenna 52. The GPS antenna 52 receives signals from the Geodetic Positioning System maintained by the Federal Government of the United States of America, and provides them to the local control circuit 24 to facilitate determination of the vehicle's location. The Geodetic Positioning System, as is well known, includes a plurality of satellites which revolve around the Earth and transmit signals which a conventional publicly-available GPS receiver can use to identify the location of the receiver in any relevant location on Earth. It will be appreciated that other embodiments may utilize other location positioning systems, such as may be provided by the Federal Government's Loran-C system. In either case, the local control circuit 24 can use the positioning information locally and provide the information to the mother vehicle 11. The mother vehicle 11, in turn, can use the information received from the unmanned undersea vehicle 12 in determining the commands to be provided to the unmanned undersea vehicle 12.

As noted above, the unmanned undersea vehicle 12 further includes a weapon compartment 22. The weapon compartment 22 stores and deploys weapons, in the form of missiles, under control of the local control circuit 24 operating, in turn, under control of the mother vehicle 11. In one embodiment, which will be described below in connection with FIGS. 3 through 7, the weapon compartment 22 deploys a plurality of weapons axially symmetrically about the unmanned undersea vehicle 12. In a second embodiment, which will be described below in connection with FIGS. 8 through 10, the weapon compartment, identified in those FIGURES, by reference numeral 22' deploys the weapons downwardly. In both cases, the weapon compartment can carry a number of missiles and deploy them individually in a plurality of locations. As it deploys the individual weapons, the weapon compartment 22 and 22' maintains axial mass symmetry, which simplifies steering of the vehicle as it is propelled through the ocean, as well as simplifying weapon deployment from multiple positions.

Figure 3:
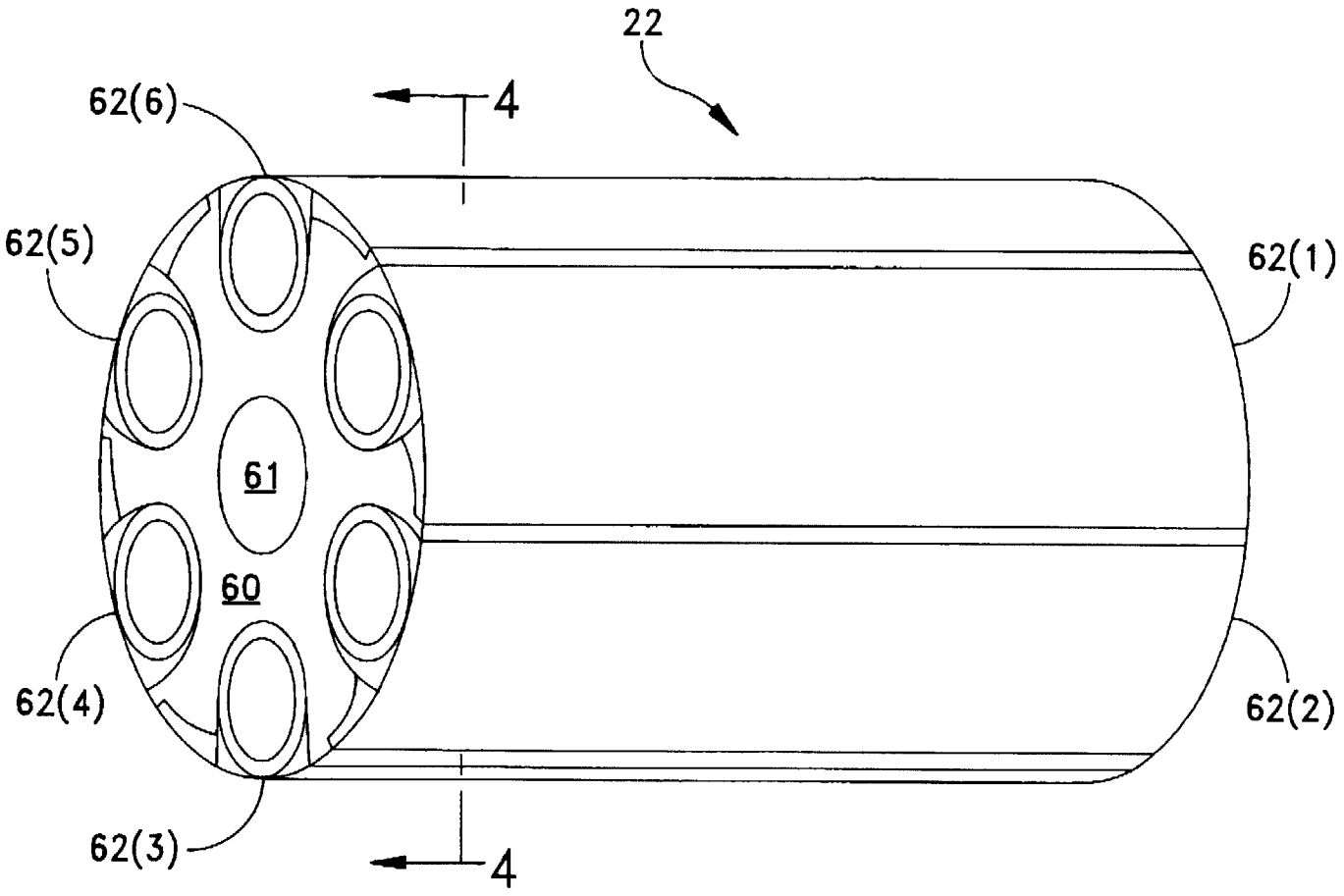
FIG. 3 depicts, in schematic form, the side perspective view of a weapon compartment useful in one embodiment of the unmanned undersea vehicle depicted in FIG. 2.
Figure 4:
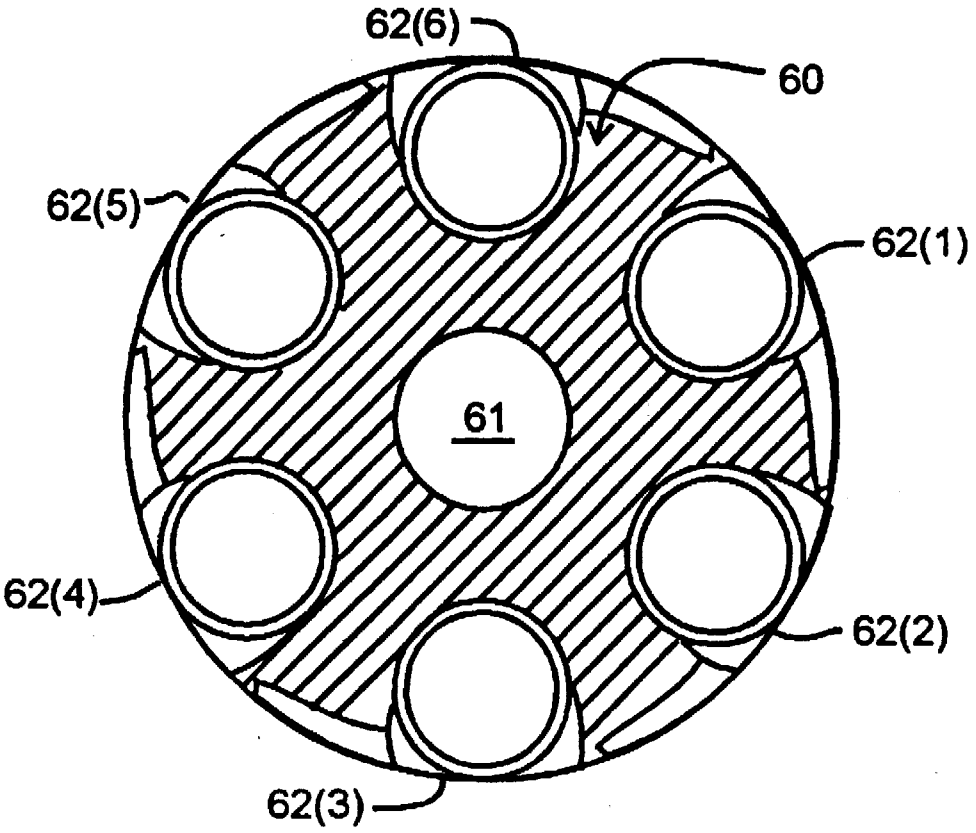
FIG. 4 depicts, in schematic form, the sectional view of the weapon compartment depicted in FIG. 3, taken along the section line 4—4 in FIGS. 2 and 3, with the weapons being situated in a non-deployment condition.
Figure 5:
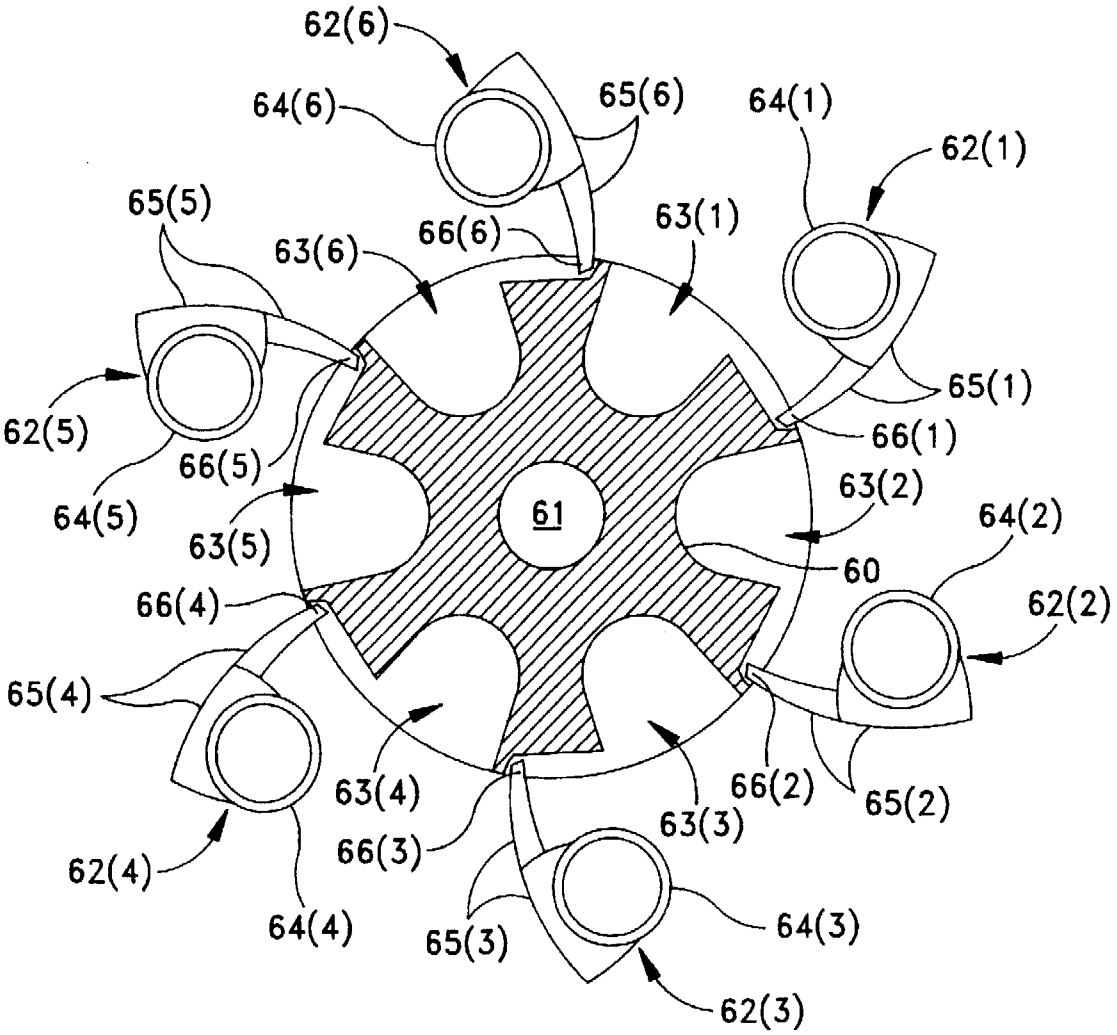
FIG. 5 depicts, in schematic form, the sectional view of the weapon compartment as depicted in FIG. 4, with the weapons being situated in a deployment condition.

FIG. 3 depicts, in schematic form, the side perspective view of weapon compartment 22, and FIG. 4 depicts, in schematic form, the sectional view of the weapon compartment depicted in FIG. 3, taken along the section line 4—4 in FIGS. 2 and 3. In FIGS. 3 and 4, the weapons are shown in retracted, non-deployed condition. FIG. FIG. 5 depicts, in schematic form, the sectional view of the weapon compartment as depicted in FIG. 4, with the weapons being situated in an extended, deployment condition. With reference to those figures, the weapon compartment 22 includes a central core 60, preferably comprising a buoyant material, having a central aperture 61 which extends therethrough from the forward control system compartment 21 to the rear control effectors compartment 23. The central aperture 61 is co-axial with the weapon compartment 22 and provides a passageway through which the connections extend between the forward control system compartment 21 and the rear control effectors compartment 23.

Figure 6:
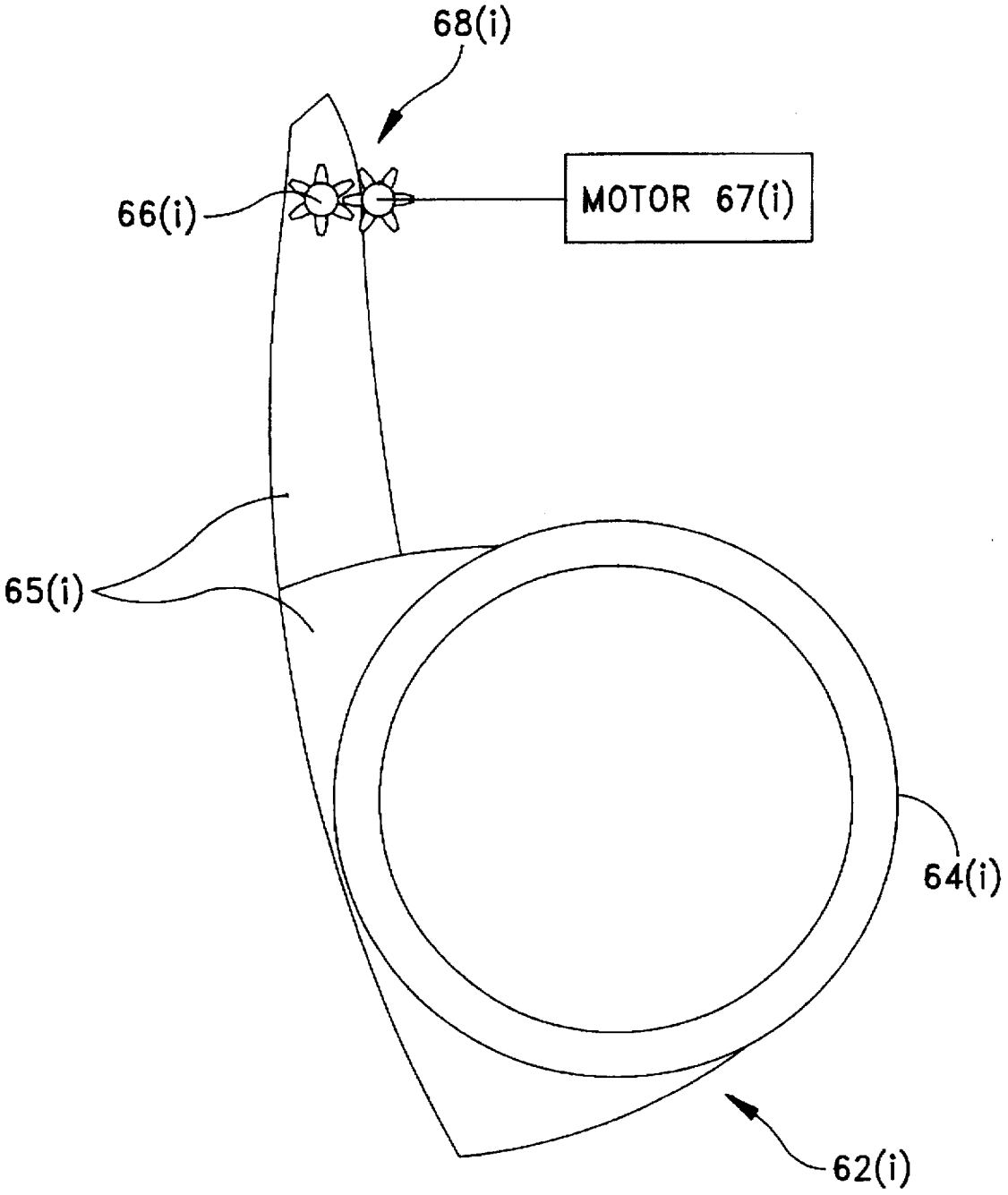
FIG. 6 depicts, in schematic form, a detail of a portion of the weapon compartment depicted in FIGS. 3 through 5, which is useful in understanding the weapon deployment operation.

In addition, around the exterior surface of the central core 60 is formed a plurality of recesses 63(1) through 63(6) (specifically shown in FIG. 5, and generally identified by reference numeral **63(*i*)). In each recess 63(*i*) is mounted a pivotable weapon deployment device 62(1) through 62(6) (generally identified by reference numeral 62(*i*)). FIGS. 3 and 4 show the weapon deployment devices 62(*i*) in a retracted, non-deployed position, FIG. 5 shows the weapon deployment devices 62(*i*) in an extended, deployed position, and FIG. 6 shows a detail of a weapon deployment device 62(1) useful in understanding deployment thereof. Each weapon deployment device 62(*i*) comprises a weapon canister 64(*i*) mounted on a pivotable arm 65(*i*). When retracted, as shown in FIGS. 3 and 4, the weapon deployment canister 64(*i*) and arm 65(*i*) fits into the respective recess 63(*i*). The outer surfaces of the arms 65(*i*) are contoured to conform to and form the cylindrical outer surface of portion of the hull 20 comprising the weapon compartment 22**.

As noted above, FIG. 5 shows the weapon deployment devices **62(*i*) in their respective deployed positions. As shown in FIG. 5, in the deployed positions, the weapon deployment devices 62(*i*) are pivoted about respective gear train 66(*i*) so that the weapon canisters 64(*i*) are positioned beyond the surface of the hull 20. As shown in FIG. 6, the weapon deployment devices 62(*i*) are pivoted between the retracted, non-deployed position and the extended, deployed position by respective electrical motors 67(*i*) through a gear train 68(*i*). The motors 67(*i*), in turn, are controlled by the local control circuit 24 (FIG. 1). It will be appreciated that a plurality of motors and associated gear trains may be situated along the length of the weapon compartment 22 to provide for more rapid pivoting of the associated weapon deployment device 62(*i*)** than may be provided by a single motor/gear train.

Figure 7:
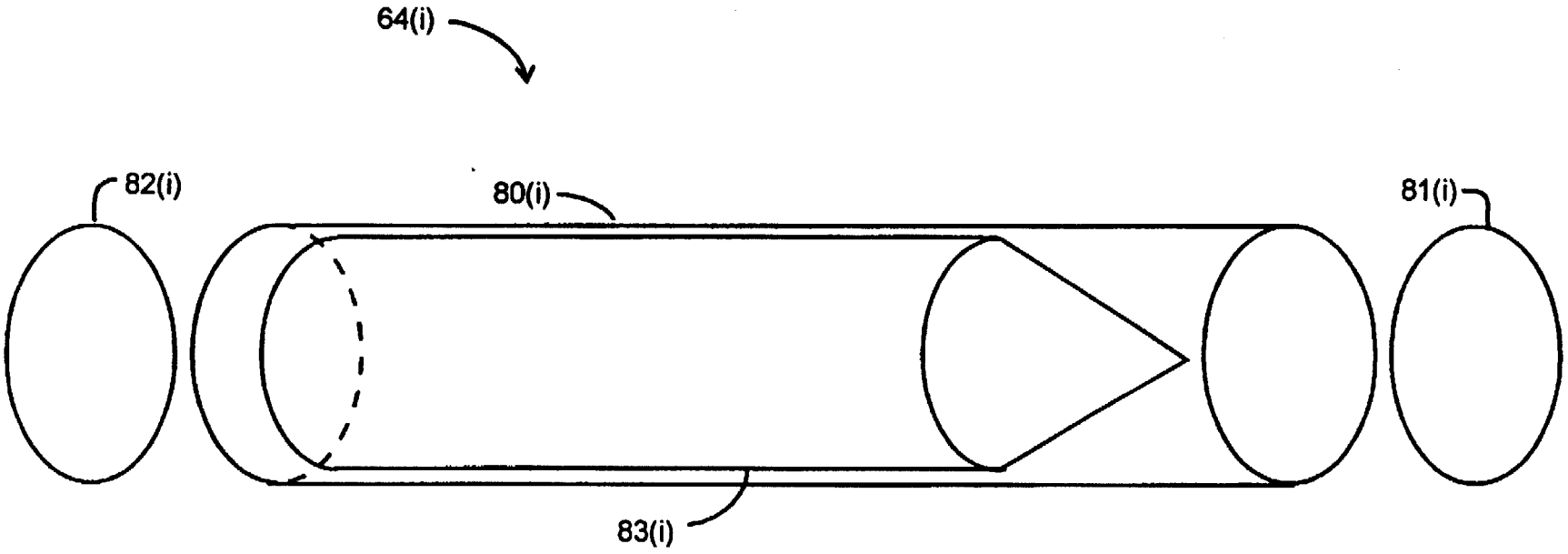
FIG. 7 depicts, also in schematic form, the detail of a weapon canister used in the weapon compartment depicted in FIGS. 3 through 6, which is useful in understanding the weapon deployment operation.

The procedure used in deploying and firing missiles from the weapon compartment 22 will be described in connection with FIG. 7, as well as FIGS. 3 through 6. Initially, the local control circuit 24, under control of the mother vehicle 11, has guided the unmanned undersea vehicle 12 to a position in which a missile is to be deployed and fired. While the unmanned undersea vehicle 12 is being propelled to the deployment and firing position, the weapon deployment devices **62(*i*) will be in the retracted, non-deployed position. After the unmanned undersea vehicle 12 arrives at the deployment and firing position, the local control circuit 24, if commanded by the mother vehicle 11 to actually deploy and fire one or more of the weapons, will actuate the motors 67(*i*) that are associated with all of the weapon deployment devices 62(*i*) and enable them to pivot the weapon deployment devices 62(*i*) to the deployed condition. By deploying all of the weapon deployment devices 62(*i*) symmetrically about the axis of the unmanned undersea vehicle 12, the unmanned undersea vehicle 12** is assured that it will not be forced from the deployment position.

After all of the weapon deployment devices **62(*i*) have been pivoted to the extended, deployed position, missiles contained in one or more of the weapon canisters 64(*i*) may be fired. The firing process will be described in connection with FIG. 7. With reference to FIG. 7, the weapon canister 64(*i*) comprises a cylindrical canister body 80(*i*), a forward end cap 81(*i*) and a rear end cap 82(*i*). Prior to firing, the end caps 81(*i*) and 82(*i*) are affixed to the canister body 80(*i*) to form a housing for a missile 83(*i*). When affixed to the canister body 80(*i*), the end caps 81(*i*) and 82(*i*) seal the interior of the canister 64(*i*)** from seawater surrounding the canister.

When the missile **83(*i*) inside of the weapon canister 64(*i*) is fired, air pressure from the combusted gases generated during the firing process builds up inside the canister 64(*i*), which enables the end caps 81(*i*) and 82(*i*) to be blown off the canister body 80(*i*). When the end caps 81(*i*) and 82(*i*) are off the canister 64(*i*)**, the missile will thereafter propel itself forward. In addition, seawater from outside of the canister will enter the interior of the canister.

After the missile **83(*i*) has been fired, the local control circuit 24 can actuate the motors 67(*i*) to enable the weapon deployment devices 62(*i*) to be pivoted between the extended, deployed position and the retracted, non-deployed position. In that operation, the seawater which entered the canisters 64(*i*) of the weapon deployment devices 62(*i*) when the respective missiles therein were fired will remain therein. The seawater in the canisters 64(*i*) for the fired missiles will help to maintain the symmetry of mass around the longitudinal axis of the unmanned undersea vehicle 12, which, in turn, will simplify controlling the unmanned undersea vehicle 12** as it thereafter propels itself beyond the weapon deployment and firing position.

While the unmanned undersea vehicle 12 including weapon compartment 22 has been depicted in FIGS. 3 through 7 as providing six weapon deployment devices **62(*i*), it will be appreciated that any number of weapon deployment devices 62(*i*) may be provided in the unmanned undersea vehicle 12**.

Figure 8:
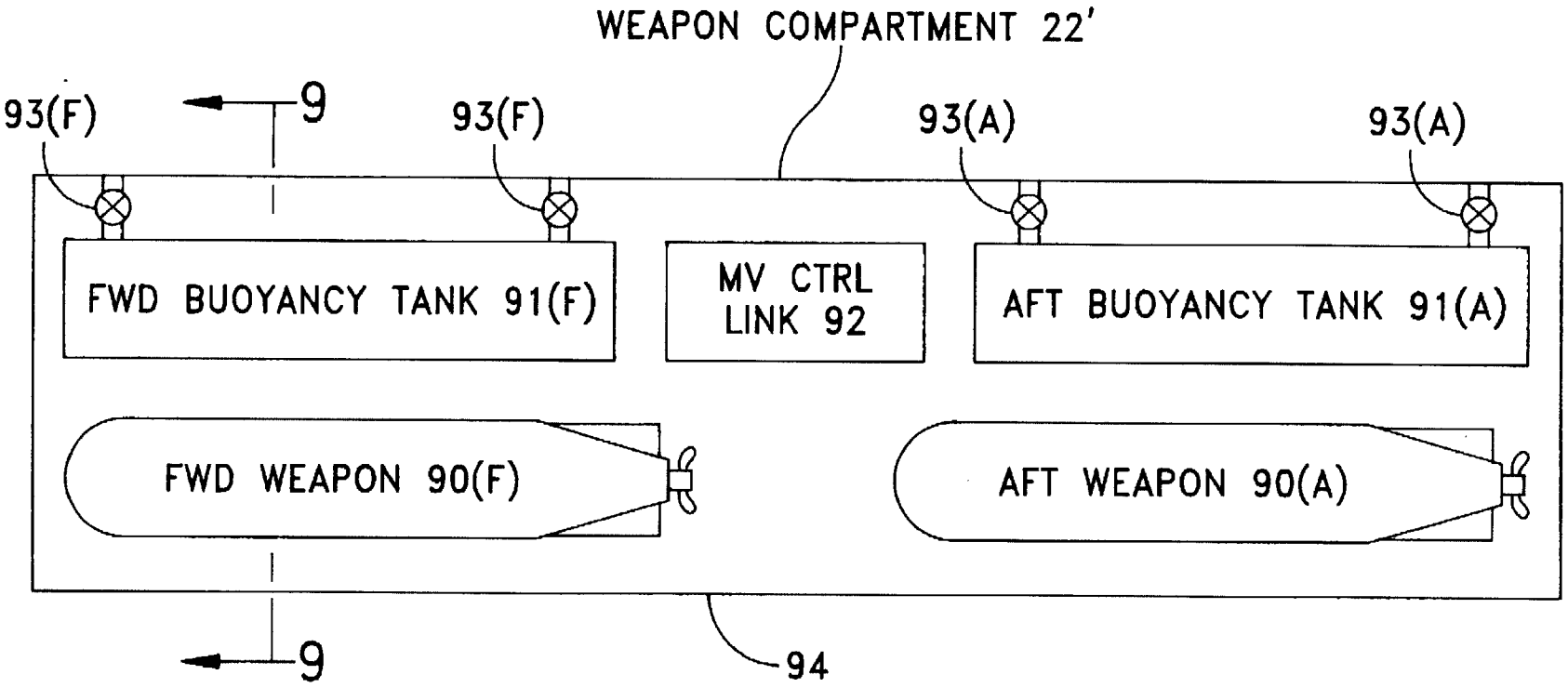
FIG. 8 depicts, in schematic form, the side perspective view of a weapon compartment useful in a second embodiment of the unmanned undersea vehicle depicted in FIG. 2.

FIG. 8 depicts, in schematic form, the side perspective view of the second embodiment weapon compartment 22'. Insofar as the invention is presently understood, weapon compartment 22' embodies the preferred mode of invention, with respect to the instant above-entitled invention. In the weapon compartment 22', two weapons 90(F) and 90(A) are positioned fore and aft toward the bottom of the weapon compartment 22'. In addition, forward and aft buoyancy tanks 91(F) and 91(A) are provide proximate to and above the correspondingly-indexed weapons 90(F) and 90(A). Positioned between the buoyancy tanks 91(F) and 91(A) is a mother vehicle control link 92, which performs the same function as mother vehicle control link 43 (FIG. 2); in a unmanned undersea vehicle 12 which incorporates weapon compartment 22', the mother vehicle control link 43 is not present in the aft control effectors compartment 23. Each buoyancy tank 91(F) and 91(A) is provided with a plurality of actuable valves 93(F) and 93(A) which provide a controllable path to enable seawater exterior of the weapon compartment to flow into the respective buoyancy tank 91(F) and 91(A) during deployment and firing of the respective weapon 90(F) and 90(A) as described below.

Figure 10:
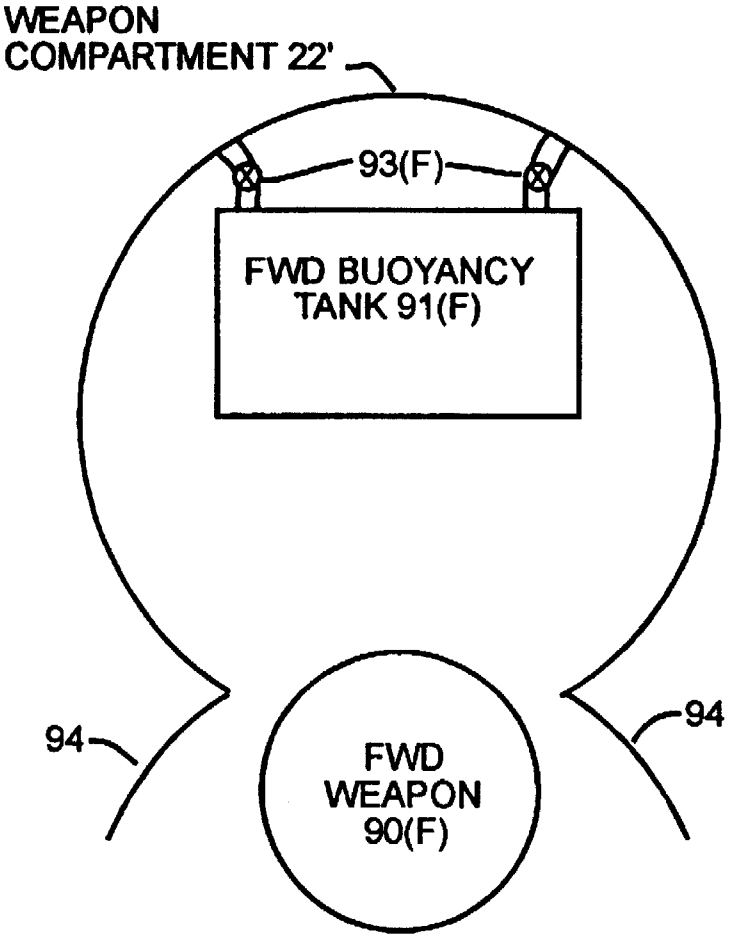
FIG. 10 depicts, also in schematic form, the sectional view of the weapon compartment depicted in FIG. 8, taken along the section line 9—9 in FIG. 8, with the weapons being situated in a deployment condition.
Figure 9:
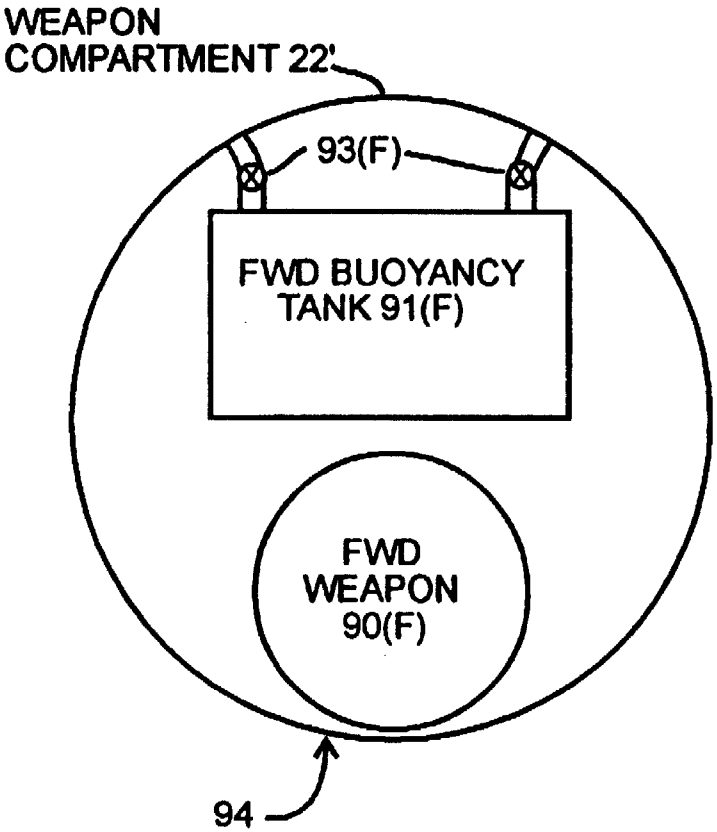
FIG. 9 depicts, also in schematic form, the sectional view of the weapon compartment depicted in FIG. 8, taken along the section line 9—9 in FIG. 8, with the weapons being situated in a non-deployment condition.

The operations performed by the unmanned undersea vehicle 12, in particular by the weapon compartment 22', in connection with deployment and firing of the weapons 90(F) and 90(A) will be described in connection with FIGS. 9 and 10. FIG. 9 depicts, also in schematic form, the sectional view of the weapon compartment depicted in FIG. 8, taken along the section line 9—9 in FIG. 8, with the weapon 90(F) being situated in a non-deployment condition; and FIG. 10 depicts, also in schematic form, the sectional view of the weapon compartment depicted in FIG. 8, taken along the section line 9—9 in FIG. 8, with the weapon 90(F) being situated in a deployment condition.

With reference to FIG. 9, weapon compartment 22' is provided with a trap door 94 proximate the weapon 90(F), to facilitate deployment and firing of the weapon. The trap door 94 is curved to provide an arc that, when closed (FIG.9), the trap door 94 forms part of the cylindrical hull 20. Initially, the unmanned undersea vehicle 12, in response to commands from the mother vehicle 11 as described above, moves to a position at which it is to deploy and fire a weapon. Thereafter, the local control circuit 24, also in response to commands from the mother vehicle 11, enables the trap door 94 to open and the weapon compartment to expel the weapon 90(F) downwardly. (It will be appreciated that weapon 90(A) can also be expelled if both weapons are to be fired contemporaneously.) After the weapon(s) has (have) been expelled to a position completely exterior of the weapon compartment 22', the weapon(s) can be fired. It will be appreciated that, to facilitate complete expulsion of the weapon(s) from the weapon compartment 22', the opening provided by the open trap door 94 will be at least as large as the diameter of the respective weapon. After deployment and firing of the weapon(s) the local control circuit 24 may enable the trap door 94 to close. Similar operations may be performed if only weapon 90(A) is to be deployed and fired.

During the deployment and firing operation, as a weapon 90(F) or 90(A) is expelled, seawater enters the cavity from which the weapon was expelled. Contemporaneously, to maintain an axially-symmetrical distribution of mass and buoyancy in the weapon compartment 22', the valves 93(F) or 93(A) connected to the respective buoyancy tank 91(F) or 91(A) are also actuated to enable seawater to enter the buoyancy tank. Accordingly, when forward weapon 90(F) is deployed and fired, the forward buoyancy tank 91(F) is filled, and when aft weapon 90(A) is deployed and fired, the aft buoyancy tank 91(A) is filled. The seawater in the buoyancy tanks 91(F) and 91(A) for the fired weapons will help to maintain the symmetry of mass around the longitudinal axis of the unmanned undersea vehicle 12, which, in turn, will simplify controlling the unmanned undersea vehicle 12 as it thereafter propels itself beyond the weapon deployment and firing position.

While the unmanned undersea vehicle 12 including weapon compartment 22' has been described as providing two weapons 90(F) and 90(A) and an associated number of buoyancy tanks 91(F) and 91(A), it will be appreciated that any number of weapons and associated buoyancy tanks may be provided in the unmanned undersea vehicle 12.

The unmanned undersea vehicle 12 provides a number of advantages. In particular, it provides a covert means for deploying multiple underwater missiles and/or torpedoes from a remotely operated and submerged platform. The unmanned undersea vehicle eliminates the necessity of having ships or submarines and their personnel at the deployment site. In addition, it provides a covert means for detecting enemy targets. The unmanned undersea vehicle is particularly useful in mapping and eliminating undersea mine fields. In addition, the unmanned undersea vehicle is relatively economical, since it is easily recoverable; the mother vehicle 11 can, through suitable commands provided to the local control circuit 24, enable the unmanned undersea vehicle to, after the weapons are deployed and fired, propel itself back to the mother vehicle 11 for retrieval. The flooding of the weapon canisters 64(*i*) in weapon compartment 22, and of the weapon cavity in weapon compartment 22', maintains the stability of the submerged unmanned undersea vehicle during the weapon deployment and launching process.

The preceding description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. An unmanned undersea vehicle system comprising:

an axi-symmetrical cylindrically-shaped self-propelled undersea deployment vehicle of predetermined diameter said undersea deployment vehicle having an amidships undersea weapon compartment;

the weapon compartment including means for receiving a weapon and a buoyancy chamber positioned generally axi-symmetrically within the weapon compartment, the buoyancy chamber being initially empty and having sufficient capacity so that it can be loaded with seawater whose mass approximates mass of the weapon;

the weapon compartment further including controllable valve means for enabling seawater surrounding the vehicle to fill the buoyancy chamber; and control means for controlling the deployment of the weapon by expelling the weapon from the weapon compartment and thereafter controlling the firing of the weapon, the control means controlling the valves means during weapon deployment to enable filling of the buoyancy chamber to maintain an axi-symmetrical distribution of mass as the weapon is deployed.

2. A vehicle as defined in claim 1 in which the weapon compartment includes trap doors proximate the weapon receiving means, the control means enabling the trap doors to open to facilitate expulsion of the weapon and thereafter enabling the trap doors to close trapping seawater therein.

3. A vehicle as defined in claim 1 in which the weapon compartment includes a plurality of weapon receiving means positioned longitudinally along the length of the vehicle, each for receiving a weapon and individually controllable to deploy the weapon, and a plurality of buoyancy chambers each associated with and located proximate one of the weapon receiving means, the control means, when enabling one of the weapon receiving means to deploy its weapon controlling filling of the proximate buoyancy tank thereby to maintain axi-symmetrical distribution of mass as the weapon is deployed.

* * * * *